United States Patent [19]

Wagner

[11] 4,030,383

[45] June 21, 1977

[54] NOSE PIECE FOR SCREWGUNS

[76] Inventor: John Bradley Wagner, 389 Montecillo Court, Walnut Creek, Calif. 94595

[22] Filed: June 30, 1976

[21] Appl. No.: 701,235

[52] U.S. Cl. ..... 81/54; 81/180 R; 144/32 R

[51] Int. Cl.[2] ..... B25B 13/00

[58] Field of Search ..... 81/54, 52.4 R, 52.5, 81/57.11, 57.12, 57.13, 57.14, 57.31, 180 R, 180 C; 144/32

[56] References Cited

UNITED STATES PATENTS

| | | | |
|---|---|---|---|
| 2,790,471 | 4/1957 | Graybill | 81/52.4 R |
| 2,796,161 | 6/1957 | Graybill | 81/52.4 R |
| 3,869,942 | 3/1975 | DeCaro | 144/32 |
| 3,934,629 | 1/1976 | Boman | 144/32 R |

*Primary Examiner*—James L. Jones, Jr.
*Attorney, Agent, or Firm*—James R. Cypher

[57] ABSTRACT

An attachment for a screwgun for driving screws to a predetermined depth. The device consists of a base member formed with threads for threadable attachment to the head of a screwgun a sleeve formed with threads for threadable attachment to the base member and a spring attached to the base and bearing against the sleeve for holding the sleeve in a preselected position.

7 Claims, 4 Drawing Figures

NOSE PIECE FOR SCREWGUNS

BACKGROUND OF THE INVENTION

This invention relates to an attachment for hand held screwguns which rotate at approximately 2000 to 5000 rpms and drives screws into various materials. These screwguns are built with automatic positive engagement clutches so that the screw bit holder rotates only when axial force is exerted on the bit holder. Thus the bit holder and the screw it is driving, cease turning when force on the screwgun is released.

Several nose pieces have been on the market for several years. All of the existing nose pieces are relatively long and therefore require a relatively long magnetic bit holder which are more expensive, introduce the probability of high speed eccentricity with resultant poor driving of the screw.

Early models were made of metal but the designs were heavy and mounting them on the end of screwguns increased operator fatigue and made the screwgun nose-heavy. Later models are made of plastic and while they are much lighter, they lack the durability required. A major problem of the plastic nose pieces is the fact that the plastic threads are easily cross-threaded and ruined so that they can no longer be attached to the screwgun.

All current nose piece designs require the use of several accessory attachments to drive the various screwhead configurations encountered in todays market.

Another problem of all existing nose pieces is the fact that they have internal locking mechanisms which become jammed with dirt and metal particles commonly found in building construction environments where the devices are used.

SUMMARY OF THE INVENTION

The gist of the present invention is the provision of a two-piece nose piece, joined by internal and external threaded portions and biased in opposite directions by a spring member.

An object of the present invention is to provide a nose piece for a screwgun which is lightweight, shorter than existing nose pieces, durable and practically free of malfunctioning due to dirt and metal particles.

A further object is to provide a nose piece which has no looseness or "play" between the parts.

Another object is to provide a nose piece which is easily set for preselected screw depth settings and will stay in adjustment.

A further object is to provide a nose piece that will drive the many screw configurations encountered in todays market without the need for accessory attachments.

Still another object is to provide a nose piece which has fewer parts, is less expensive to manufacture and assemble then present devices.

Figure 1:
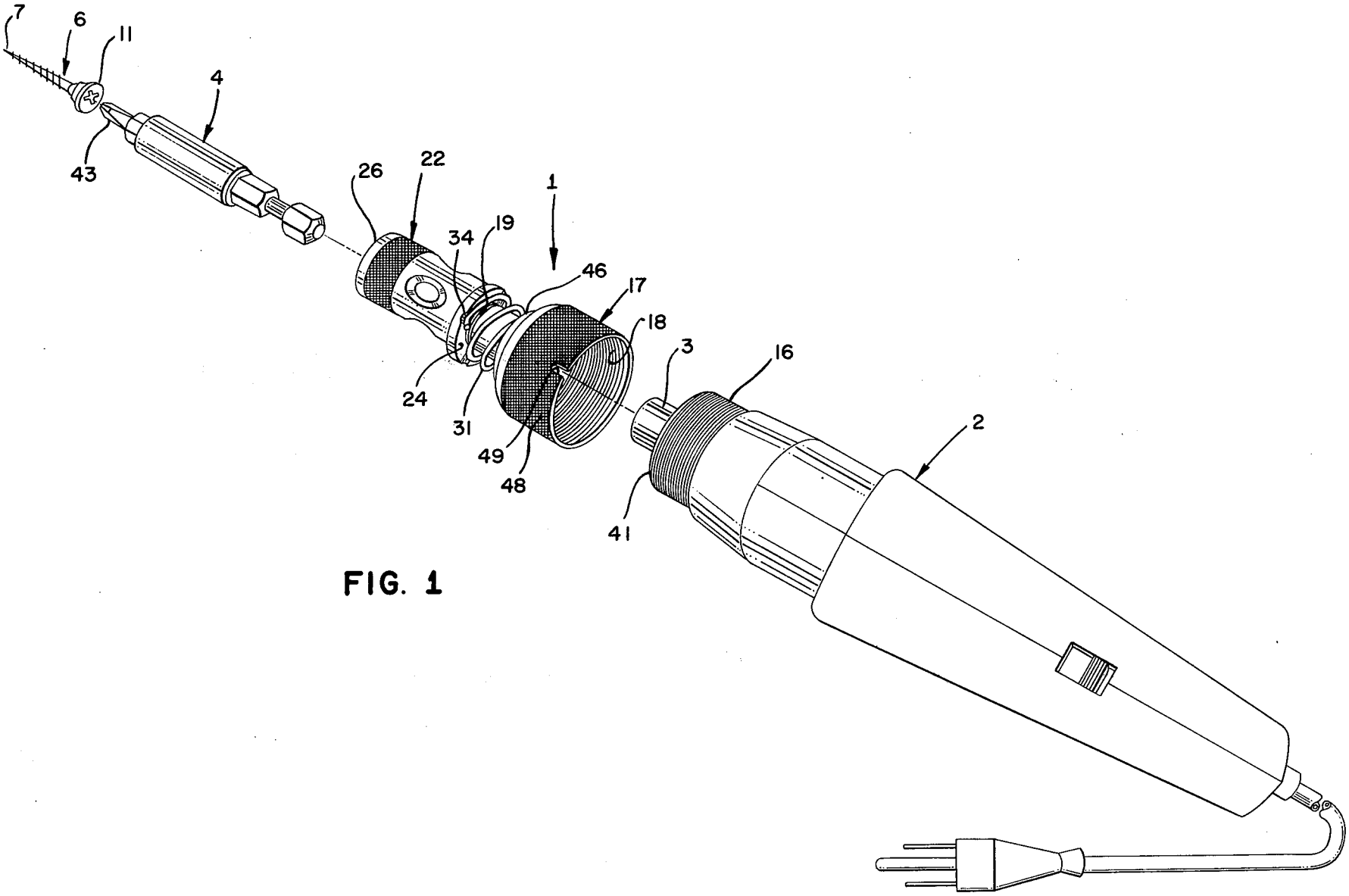
FIG. 1 is an exploded perspective view of the nose piece of the present invention and a standard screwgun.
Figure 2:
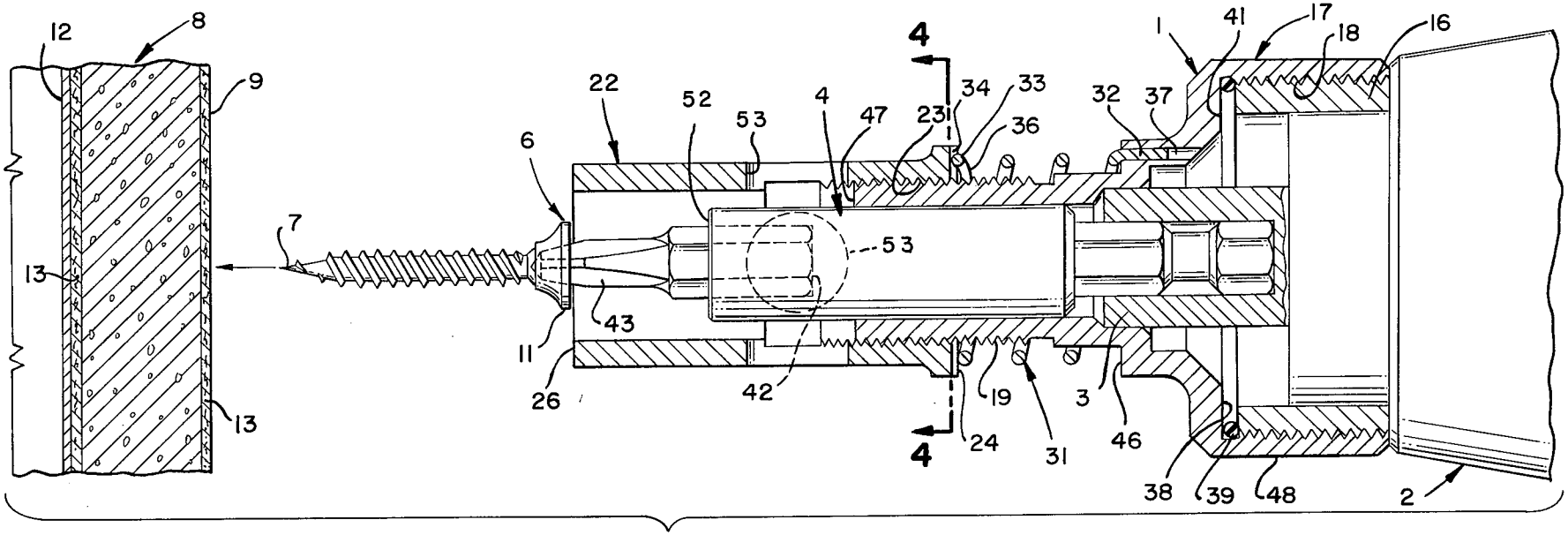
FIG. 2 is an enlarged cross sectional view of the nose piece shown in FIG. 1 connected to the screwgun and with the bit holder connected to the driving means of the screwgun. A gypsum broad screw is shown; held in position by the magnetic bit tip.
Figure 4:
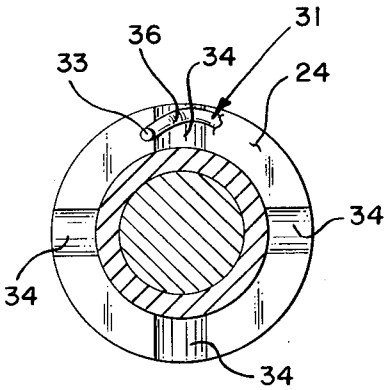
FIG. 4 is a cross sectional view of the nose piece taken along line 4—4 of FIG. (2).
Figure 3:
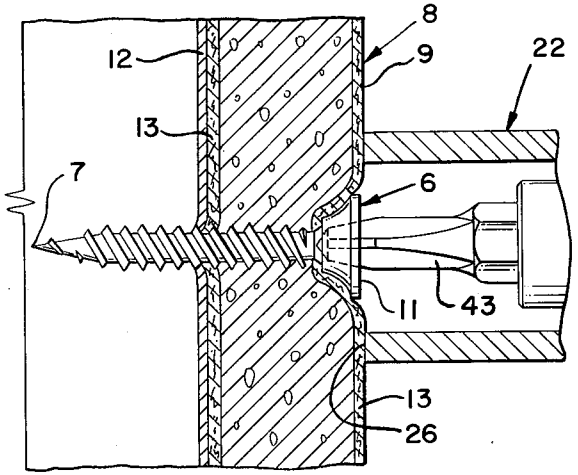
FIG. 3 is a cross section of a portion of the nose piece. This view shows the final driven position of the gypsum broad screw in the wall board.

BRIEF DESCRIPTION OF THE PREFERRED EMBODIMENTS OF THE INVENTION:

The present invention relates to a nose piece generally shown by the number 1 for a screwgun referred to generally by the number 2. While the screwgun is not a part of the invention, it is necessary to the understanding of the invention to know the operation of the screwgun.

The screwgun motor operates at a nearly constant approximately 2000 to 5000 rpm but a positive engagement clutch is operatively connected to the motor which disconnects the motor from the driving shaft 3 for the bit holder 4 until an axial force is applied to the driving shaft. Thus, the bit holder and the screw 6 remain stationary until the tip 7 of the screw is pressed into the material 8 being attached. When sufficient axial force is built up, the clutch becomes engaged and the motor turns the bit holder and the screw. When the pressure is released from the screw as by not pressing forward on the screw or when pressure is prevented as by the nose piece of this invention, then the rotation of the screw is prevented because of the disengagement of the clutch.

The function of the nose piece of the present invention is to enable the screwgun operator to stop the forward motion of the screw at a precise predetermined distance below the surface 9 of the material being fastened by the screw.

The precise location of the head 11 of a screw 6 into the material 8 is extremely important in applications such as the attachment of gypsum board to metal studs 12. In such applications, if the head of the screw is stopped above or flush with the paper 13, the head of the screw can not be covered with the gypsum cement to conceal it from view. On the other hand, if the screw is not stopped with the head just slightly below the surface of the paper, the paper will be torn and the holding power of the screw greatly reduced. It is therefore necessary that the head of the screw in wallboard installations be stopped just below the surface of the outer layer of paper.

The nose piece of the present invention is threadably connected to an externally threaded annular head 16 connected to the screwgun and which surrounds the rotatable power driven shaft 3. The annular head does not rotate; being fixedly connected to the housing of the screwgun.

The nose piece of the present invention consists of only three parts. The first part is the base member 17 which includes a cylindrical interally threaded first wall 18 adapted to threadably mating with the externally threaded annular screwgun head, and a second cylindrical externally threaded wall 19 and a spring end receiving means 37.

The second part is a cylindrical nose piece member 22 which has a portion 23 internally threaded for threadably mating with the second cylindrical threaded wall of the base member, a spring retaining planar annular surface 24 presented toward the base member, and a planar annular face 26 adapted for engaging a work surface 9.

The third part is a spring 31 coaxially surrounding the second wall of the base member having a first end 32 engaging the spring receiving means on the base member and having a second end 33 slidably engaging the spring retaining planar annular surface 24. The function of the spring is to bias the base member and nose piece members away from one another. One purpose of the spring is to eliminate all movement between the base member and the nose piece member by eliminating all movement between the mating threads of the base member and the nose piece.

In order to selectively set the nose piece 1 so that it will prevent the insertion of a screw below a preselected point, the nose piece member 22 is rotated with respect to the base member 17. To assist the nose piece member in remaining at the preselected position, the nose piece is provided with indexing means 34. The indexing function is accomplished by forming the second end of the spring with indexing means.

The end of the spring may be bent outwardly or preferably adjacent the end of the spring a sharp rounded offset 36 is formed in the spring. This offset portion is positioned to selectively nest in one of a plurality of spaced indents 34 formed in the spring retaining planar annular surface 24 of the nose piece. The indents are rounded so that the spring may slide in and out of the indent upon the application of a rotational force by the fingers on the nose piece member. The fact that the spring 31 constantly biases the nose piece member and the base member away from one another forces the offset portion of the spring into the indent and prevents relative rotation between the two members.

To assist in the indexing function, the first end 32 of the spring is connected to the base member to prevent rotation of the spring relative to the base member. This may be accomplished by drilling or forming an opening 37 or a recess and inserting the end of the spring therethrough.

To assist the nose piece in remaining firmly on the threaded annular head of the screwgun, the base member is formed with an internal annular shoulder 38 adjacent the first wall and a compressible "O" ring 39 dimensioned for registration with the annular shoulder is provided to frictionally engage the leading surface 41 of the head of the screwgun. The O-ring is made from rubber or other flexible material which will compress. Thus, when the base is rotated until it compresses the O-ring, the increased friction of the rubber on metal prevents the base from "backing" off and the nose piece from becoming loosened and thus destroy the precise setting of the nose piece member.

Commercial bit holders have magnetic ends 42 for holding the bit tips 43. In order to prevent loss of magnetic strength or to cause the bit tip to couple with the nose piece, the cylindrical nose piece member 22 is preferably constructed from a non-magnetic material such as non-magnetic stainless steel.

The nose piece of the present invention could be made from plastic materials, but to give the member the desired durability, it is preferably made from metals.

As a specific example, some key dimensions are set forth below in describing the invention. The base member 17 is 2 inches long and the distance between annular face 46 and the end face 47 is 1 inches. Outer wall 48 has a stock diameter of 1½ inches and the threaded internal wall has a diameter of 1⅜ inches. In order to re-cut damaged threads on the head of the screwgun, the internal wall is notched at one place as indicated by the number 49 to a depth of three-sixtenths and one-eighth inch wide. The base of the notch is given a radius of 00/.06.

Externally threaded wall 19 has a diameter of five-eighths inch and the inside diameter is 0.447 to 0.449 inch. Internal wall 51 has a diameter of 0.500 to 0.510 inch.

The dimensions of the nose piece member 22 of the specific example are as follows: The overall length is 1 7/16 inches. The outside diameter is between 0.765 and 0.775 inch, and the inside diameter is between 0.575 and 0.585 inch. The internally threaded wall 23 has a minor diameter of from 0.580 to 0.583 inch. Threaded portion 23 is formed with standard ⅝–24 UNF threades which match with the same thread size for externally threaded wall 19 on the base member. Spring retainer annular face 26 has an outside diameter of seven-eighths inch. Indexing means 34 have a width of five thirty-seconds inch.

The operation of the device is as follows: The nose piece 1 is threadably attached to the annular threaded head of the screwgun 1. The nose piece is turned until O-ring 39 is compressed against the leading surface 41 of the head of the screwgun.

The nose piece member is rotated until the approximate depth setting is found. A screw 6 is then placed on the bit 43 and the point 7 is placed against wall board 8. Pressure transmitted through bit holder 4 to shaft 3 of the screwgun actuates the friction clutch and rotates the screw until annular face 26 reaches surface 9 of the material. At this point, axial force on the bit holder is released and the clutch disengages thereby stopping rotation of the screw. Adjustment of the nose piece is then made by rotating the nose piece member 22 either clockwise or counterclockwise the desired amount. By dividing face 34 into 4 indexing means, the nose piece member can be indexed a quarter turns of the member. Spring offset 36 prevents relative rotation between the base member and the nose piece member by indexing with indents 34.

Overall length of the nose piece is between 2½ inches and about 3⅛ inches. Competing nose pieces have a minimum length of between 3¾ inches and 4 inches.

Weight of the nose piece of the above application is 4½ ounces compared with plastic nose pieces which weigh 4 ounces and metal nose pieces which weigh as much as 9¼ ounces.

To prevent build up of gypsum dust on the front face 52 of the bit holder and face 47 of the nose piece member 1, four openings 53 are formed in the cylindrical nose piece member 22. Unlike the prior art devices where the holes are formed immediately adjacent the forward end next to the bit, the openings 53 are formed in the cylindrical nose piece member 22 relatively far back so that centrifugal force of the bit holder will discharge the foreign matter from the space between the bit holder and the cylindrical nose piece member 22. It is very important that this foreign matter be ejected to prevent the gypsum dust from working between threads 23 and 19 and prevent the necessary depth adjustment. As an example, openings 53 are 0.358 inch in diameter; equally spaced 90° apart with the center line of the holes spaced five-eighths inch from annular surface 24.

One of the most salient features of the cylindrical nose piece member is the internal diameter. It is large enough to accommodate one-fourth inch, five-sixteenths inch, and three-eighths inch hex washer head screws, wafer head screws and others without the necessity of purchasing and fixing accessory attachments to drive these screws unlike every other model on the market which does require accessory attachments to drive the screws mentioned. Some use as many as three attachments. Some require an entirely different design. None on the market are as simple, flexible, efficient and universal as the present invention.

I claim:

1. A nose piece for a screwgun having an externally threaded annular head surrounding the rotatable power driven shaft comprising:

a. a base member including a cylindrical internally threaded first wall adapted for threadably mating with said externally threaded annular screwgun head, a second cylindrical externally threaded wall and spring end receiving means;

b. a cylindrical nose piece member having a portion internally threaded for threadably mating with said second cylindrical threaded wall of said base member, a spring retaining planar annular surface presented toward said base member and a planar annular face adapted for engaging a work surface; and c. a spring coaxially surrounding said second wall of said base member having a first end engaging said spring receiving means on said base member and having a second end slidably engaging said spring retaining planar annular surface and biasing said base member and nose piece members away from one another.

2. A nose piece as described in claim 1 comprising:

a. said second end of said spring is formed with indexing means; and b. said spring retaining planar annular surface of said nose piece is formed with spaced indents for slidably receiving said second end of said spring.

3. A nose piece as described in claim 2 comprising:

a. said first end of said spring is connected to said base member to prevent rotation of said spring relative to said base.

4. A nose piece as described in claim 1 comprising:

a. said base member is formed with an internal annular shoulder adjacent said first wall; and b. a compressible O-ring dimensioned for registration with said annular shoulder and adapted for frictionally engaging said head of said screwgun.

5. A nose piece as described in claim 1 comprising:

a. said cylindrical nose piece member is constructed from a non-magnetic material.

6. A nose piece as described in claim 5 comprising:

a. said base member, cylindrical nose piece member and said spring are constructed from metal materials.

7. A nose piece as described in claim 1 comprising:

a. said base member and cylindrical nose piece members are formed with openings therethrough having a selected diameter adapted for receiving one-fourth inch, five-sixteenths inch and three-eighths inch hex head washer head screws.

* * * * *